US010593259B2

(12) United States Patent
Deng et al.

(10) Patent No.: US 10,593,259 B2
(45) Date of Patent: Mar. 17, 2020

(54) METHOD AND DEVICE FOR COMPENSATING BRIGHTNESS OF AMOLED DISPLAY PANEL

(71) Applicant: SHENZHEN CHINA STAR OPTOELECTRONICS SEMICONDUCTOR DISPLAY TECHNOLOGY CO., LTD., Shenzhen, Guangdong (CN)

(72) Inventors: Yufan Deng, Guangdong (CN); Shen-Sian Syu, Guangdong (CN)

(73) Assignee: SHENZHEN CHINA STAR OPTOELECTRONICS SEMICONDUCTOR DISPLAY TECHNOLOGY CO., LTD, Shenzhen, Guangdong (CN)

( * ) Notice: Subject to any disclaimer, the term of this patent is extended or adjusted under 35 U.S.C. 154(b) by 125 days.

(21) Appl. No.: 15/736,311

(22) PCT Filed: Dec. 12, 2017

(86) PCT No.: PCT/CN2017/115594
§ 371 (c)(1),
(2) Date: Dec. 14, 2017

(87) PCT Pub. No.: WO2019/029070
PCT Pub. Date: Feb. 14, 2019

(65) Prior Publication Data

US 2019/0051236 A1 Feb. 14, 2019

(30) Foreign Application Priority Data

Aug. 8, 2017 (CN) ..... 2017 1 0669965

(51) Int. Cl.
*G09G 3/3225* (2016.01)
*G09G 3/3208* (2016.01)
*G09G 3/20* (2006.01)

(52) U.S. Cl.
CPC ..... *G09G 3/3225* (2013.01); *G09G 3/2007* (2013.01); *G09G 3/3208* (2013.01); *G09G 2320/0233* (2013.01); *G09G 2320/0271* (2013.01); *G09G 2320/0285* (2013.01); *G09G 2320/043* (2013.01); *G09G 2320/045* (2013.01); *G09G 2320/048* (2013.01); *G09G 2320/0626* (2013.01); *G09G 2330/12* (2013.01)

(58) Field of Classification Search
None
See application file for complete search history.

(56) References Cited

U.S. PATENT DOCUMENTS

2009/0002311 A1* 1/2009 Barnhoefer ..... G09G 3/3406 345/102
2016/0300534 A1* 10/2016 Kishi ..... G09G 3/3233

* cited by examiner

*Primary Examiner* — Duane N Taylor, Jr.
(74) *Attorney, Agent, or Firm* — Soroker Agmo Nordman

(57) ABSTRACT

A method and a device for compensating brightness of an AMOLED display panel are provided. The method is simple, and the device is simple in structure and is easy to operate. By performing an aging experiment on the display panel in advance, an attenuation law that the brightness of sub-pixels varies with time and gray levels is obtained, and a compensation data is computed and a dynamic compensation table is generated. A correcting module corrects the inputted original gray levels based on the dynamic compensation table and the brightness of sub-pixels are compensated such that the display panel can display images normally.

13 Claims, 3 Drawing Sheets

METHOD AND DEVICE FOR COMPENSATING BRIGHTNESS OF AMOLED DISPLAY PANEL

CROSS REFERENCE TO RELATED APPLICATION

This application claims the priority of International Application No. PCT/CN2017/115594 filed on Dec. 12, 2017, titled "METHOD AND DEVICE FOR COMPENSATING BRIGHTNESS OF AMOLED DISPLAY PANEL", which claims priority to Chinese Application No. 201710669965.3 filed on Aug. 8, 2017. The entire disclosures of each of the applications are incorporated herein by reference.

BACKGROUND

1. Field of the Disclosure

The present disclosure relates to display technologies, and more particularly to a method and device for compensating brightness of an active-matrix organic light-emitting diode (AMOLED) display panel

2. Description of the Related Art

Organic light-emitting diode (OLED) technology is a new star of flat panel displays, and is widely used in terminal devices such as cell phones, digital cameras, tablets, and televisions, because of its self-illuminating property, no backlight source, power savings, and wide viewing angles.

OLED display devices can be categorized into two major types according to the driving method, which are passive matrix OLED (PMOLED) devices and active matrix OLED (AMOLED) devices, i.e., two types of the direct addressing and the thin film transistor (TFT) matrix addressing. The AMOLED includes pixels arranged in arrays and belongs to active display type, which has high lighting efficiency and is generally utilized for high resolution, large scale display devices.

Under current production processes, OLED display devices have temporal and spatial non-uniformity issues. As size of the display device increases, such issues are becoming even more serious. Therefore, solving display non-uniformity issues in large sized OLED display devices is an indispensable key technique for mass production. The display non-uniformity issues in OLED display devices are closely related to the production processes. Overall luminance uniformity of the display device gets worse when there is a relatively large difference among threshold voltage values of the whole panel.

With continuous reform and improvement on OLED display production and package processes, it is increasingly difficult to make breakthrough in lifetimes of OLED displays from manufacturing processes. Internal circuit compensation needs to increase number of thin film transistors and capacitors and thus causes a decrease in aperture ratio. Also, the internal circuit compensation is limited in improving the lifetime of OLED displays. Accordingly, future research in this field is directed to external circuit compensation and image processing approaches for improving the lifetime of OLED displays.

As to improving the lifetime of OLED displays using the external circuit compensation and image processing approaches, degree of brightness attenuation of the OLED displays has to be determined first. Currently, an external detection circuit is primarily used to detect an anode voltage of the OLED display in real time to determine the degree of brightness attenuation. However, such an approach cannot determine the degree of brightness attenuation of the OLED display directly from gray levels of an image shown on the OLED display and the elapsed time. In addition, this approach can inspect aging of thin film transistors but not aging of OLED devices. Also, this approach requires addition of a measuring circuit to the display panel.

SUMMARY

The present disclosure provides a method and device for compensating brightness of an AMOLED display panel for solving the brightness attenuation problem of the AMOLED display panel.

To solve above problem, technical schemes provided in the present disclosure are described below.

The present disclosure provides a method for compensating brightness of an AMOLED display panel, including:

Step S20: converting a video signal received by an input module into original gray levels that are identifiable by a correcting module;

Step S30: inputting the original gray levels into the correcting module and using the correcting module to correct the original gray levels according to a dynamic compensation table;

Step S40: transmitting the corrected original gray levels to a display module and a computing module; and Step S50: using the computing module to compute an attenuation law according to the corrected original gray levels and modify the dynamic compensation table over time.

In accordance with a preferred embodiment of the present disclosure, before Step S20, the method further includes:

Step S10: computing a compensation data and generating the dynamic compensation table, wherein there is a one-to-one correspondence between the compensation data and at least one of a gray-level electric current, time, and a pixel brightness decline in the dynamic compensation table.

In accordance with a preferred embodiment of the present disclosure, Step S10 includes:

Step S101: performing an aging experiment on a pre-selected AMOLED display panel to obtain experimental data; and Step S102: obtaining the compensation data and the dynamic compensation table according to the experimental data in combination with $f=k\cdot\int(\text{gray}(t)\hat{}\gamma)dt$, where f is a brightness attenuation ratio, f corresponds to the compensation data, k is the pixel brightness decline per unit of time and per unit of electric current, gray(t) is the gray-level electric current at time t, γ is a gamma value of the pre-selected AMOLED display panel, and t represents time.

In accordance with a preferred embodiment of the present disclosure, Step S30 includes:

S301: inputting the original gray levels into the correcting module; and

S302: correcting the original gray levels by the correcting module using the compensation data and a correction formula $x/(1=f)^{1/\gamma}$, where x represents the original gray levels and f is the brightness attenuation ratio.

In accordance with a preferred embodiment of the present disclosure, Step S30 includes:

after receiving the brightness attenuation ratio of the display panel transmitted by the computing module, adding up the received value and an original value stored in the dynamic compensation table as an updated brightness attenuation ratio, and transmitting the corrected result to the display module.

The present disclosure provides a device for compensating brightness of an AMOLED display panel, the device having a compensation circuit timing controller including an input module, a correcting module, a computing module, a dynamic compensation table, and a display module;

the input module configured to receive a video signal and convert the video signal into original gray levels that are identifiable by the correcting module; and the correcting module configured to correct the original gray levels according to the dynamic compensation table and transmit the corrected original gray levels to the display module and the computing module, wherein the computing module computes an attenuation law according to the corrected original gray levels and modifies the dynamic compensation table over time; and wherein there is a one-to-one correspondence between a compensation data and at least one of a gray-level electric current, time, and a pixel brightness decline in the dynamic compensation table.

In accordance with a preferred embodiment of the present disclosure, an aging experiment is performed on a pre-selected AMOLED display panel to obtain experimental data; and the compensation data and the dynamic compensation table are obtained according to the experimental data in combination with $f=k\cdot\int(gray(t)\hat{}\gamma)dt$ where f is a brightness attenuation ratio, f corresponds to the compensation data, k is the pixel brightness decline per unit of time and per unit of electric current, gray(t) is the gray-level electric current at time t, γ is a gamma value of the pre-selected AMOLED display panel, and t represents time.

In accordance with a preferred embodiment of the present disclosure, the correcting module corrects the original gray levels according to a brightness attenuation ratio stored in the dynamic compensation table and transmits the corrected result to the display panel; and a correction formula used to correct the original gray levels is $x/(1-f)^{1/\gamma}$, where x represents the original gray levels and f is the brightness attenuation ratio.

In accordance with a preferred embodiment of the present disclosure, after the brightness attenuation ratio of the display panel transmitted by the computing module is received, the received value and an original value stored in the dynamic compensation table are added up as an updated brightness attenuation ratio, and the corrected result is transmitted to the display module.

The present disclosure provides a device for compensating brightness of an AMOLED display panel, the device having a compensation circuit timing controller including an input module, a correcting module, a computing module, a dynamic compensation table, and a display module;

the input module configured to receive a video signal and convert the video signal into original gray levels that are identifiable by the correcting module; and the correcting module configured to correct the original gray levels according to the dynamic compensation table and transmit the corrected original gray levels to the display module and the computing module, wherein the computing module computes an attenuation law according to the corrected original gray levels and modifies the dynamic compensation table over time.

In accordance with a preferred embodiment of the present disclosure, an aging experiment is performed on a pre-selected AMOLED display panel to obtain experimental data; and a compensation data and the dynamic compensation table are obtained according to the experimental data in combination with $f=k\cdot\int(gray(t)\hat{}\gamma)dt$, where f is a brightness attenuation ratio, f corresponds to the compensation data, k is the pixel brightness decline per unit of time and per unit of electric current, gray(t) is the gray-level electric current at time t, γ is a gamma value of the pre-selected AMOLED display panel, and t represents time.

In accordance with a preferred embodiment of the present disclosure, the correcting module corrects the original gray levels according to a brightness attenuation ratio stored in the dynamic compensation table and transmits the corrected result to the display panel; and a correction formula used to correct the original gray levels is $x/(1-f)^{1/\gamma}$, where x represents the original gray levels and f is the brightness attenuation ratio.

In accordance with a preferred embodiment of the present disclosure, after the brightness attenuation ratio of the display panel transmitted by the computing module is received, the received value and an original value stored in the dynamic compensation table are added up as an updated brightness attenuation ratio, and the corrected result is transmitted to the display module.

The beneficial effects of the present disclosure are described below. Compared to the current skills, the display panel brightness compensation device of the present disclosure is simple in structure and is easy to operate, and the method is simple. By performing the aging experiment on the display panel in advance, an attenuation law that the brightness of sub-pixels varies with time and gray levels is obtained, and the compensation data is computed and the dynamic compensation table is generated. The correcting module corrects the inputted original gray levels based on the dynamic compensation table and the brightness of sub-pixels are compensated such that the display panel can compensate the aging of thin film transistors and attenuation of luminance efficiency of OLED devices without it being necessary to dispose circuits or sensors in the display panels for luminance measurement, and the display panel can display images normally.

BRIEF DESCRIPTION OF THE DRAWINGS

For explaining the technical schemes used in the conventional skills and the embodiments of the present disclosure more clearly, the drawings to be used in the embodiments or the descriptions on the conventional skills will be briefly introduced in the following. Obviously, the drawings below are only some embodiments of the present disclosure, and those of ordinary skill in the art can further obtain other drawings according to these drawings without making any inventive effort.

DETAILED DESCRIPTION OF THE PREFERRED EMBODIMENTS

Figure 1:
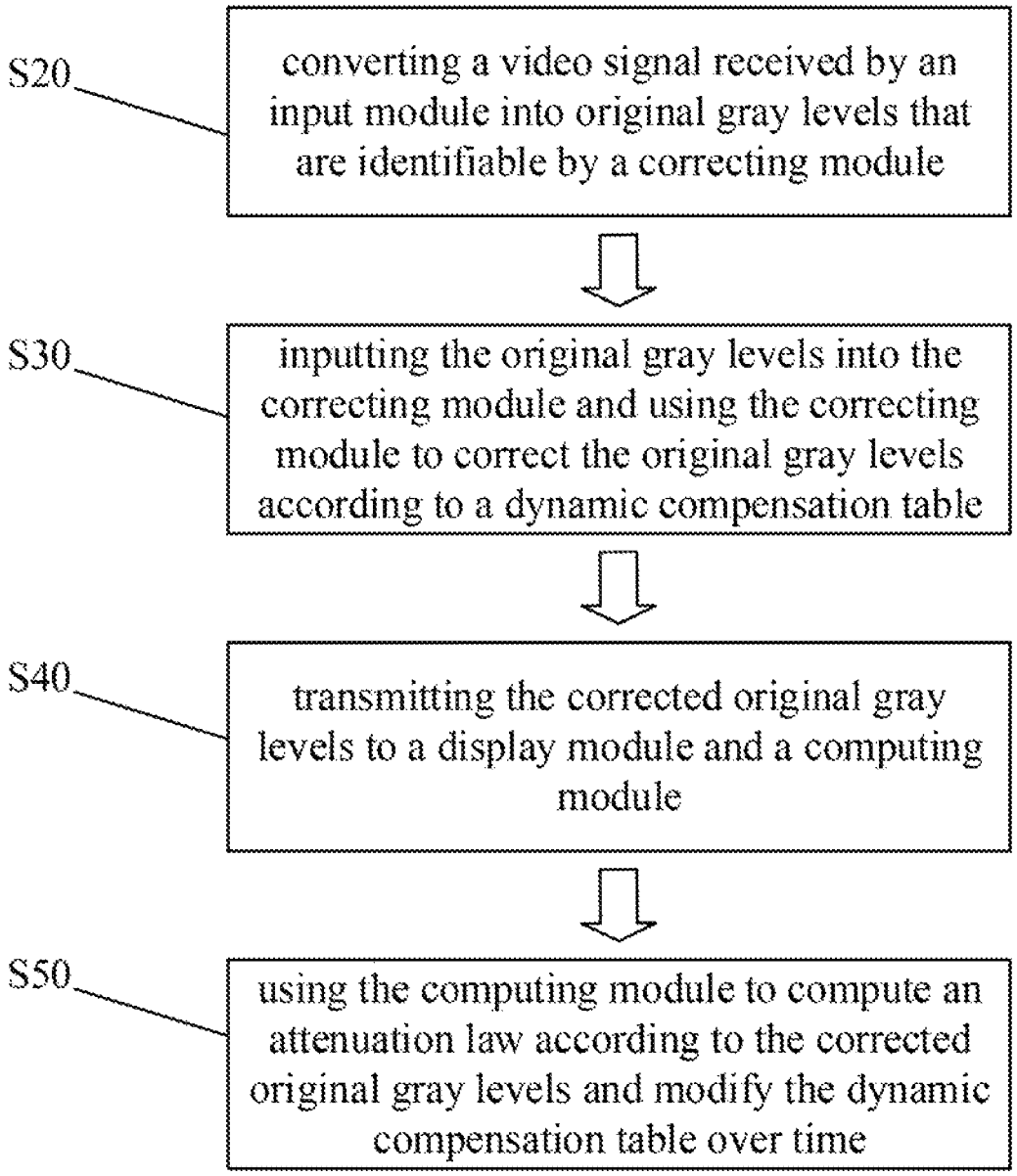
FIG. 1 is a flowchart of a method for compensating brightness of an AMOLED display panel in accordance with the present disclosure.

The following descriptions for the embodiments are specific embodiments capable of being implemented for illustrating the present disclosure with referring to the appending figures. In describing the present disclosure, spatially relative terms such as "upper", "lower", "front", "back", "left", "right", "inner", "outer", "lateral", and the like, may be used herein for ease of description as illustrated in the figures. Therefore, the spatially relative terms used herein are intended to illustrate the present disclosure for ease of understanding, but are not intended to limit the present disclosure. In the appending drawings, units with similar structures are indicated by the same reference numbers.

Brightness compensation devices used in current AMOLED display panels need circuits or sensors to be disposed in the display panels for luminance measurement, and can only inspect aging of thin film transistors but are unable to inspect aging of OLED devices. This leads to complicated steps and structures. Embodiments of the present disclosure are provided for solving these problems.

The present disclosure provides a method for compensating brightness of an AMOLED display panel. The method includes the following steps.

In Step S10, compute a compensation data and generate a dynamic compensation table. There is a one-to-one correspondence between the compensation data and at least one of a gray-level electric current, time, and a pixel brightness decline in the dynamic compensation table.

A device for compensating brightness of an AMOLED display panel is provided to perform an aging experiment on the AMOLED display panel, and measure and record a decline in brightness of sub-pixels on the display panel or a change of the brightness varied with time or a gray-level electric current. In the aging experiment, a display process causes a decrease in the brightness of each of the sub-pixels and a brightness attenuation ratio is obtained from the experiment.

The compensating device includes a compensation circuit timing controller. The compensation circuit timing controller includes an input module, a correcting module, a computing module, a dynamic compensation table, and a display module.

The compensation data and the dynamic compensation table are obtained according to the experimental data in combination with $f=k\cdot\int(\text{gray}(t)\hat{}\gamma)dt$. There is a one-to-one correspondence between the compensation data and at least one of a gray-level electric current, time, and a pixel brightness decline in the dynamic compensation table.

For example, assuming that the resolution of the display panel is 1920*1080, then the number of sub-pixels on the display panel is 1920*1080*3. Based on the aforesaid formula, a one-to-one mapping is formed between the sub-pixels and the data in the dynamic compensation table.

Further, in the aforesaid formula, f is the brightness attenuation ratio, f corresponds to the compensation data, k is the pixel brightness decline per unit of time and per unit of electric current, gray(t) is the gray-level electric current at time t, γ is a gamma value of the pre-selected AMOLED display panel, and t represents time.

In Step S20, a video signal received by the input module is converted into original gray levels that are identifiable by the correcting module.

In Step S30, the original gray levels are inputted into the correcting module, and the correcting module corrects the original gray levels according to the dynamic compensation table.

The correcting module corrects the inputted original gray levels according to the established dynamic compensation table. A correction formula used to correct the original gray levels is $x/(1-f)^{1/\gamma}$, where x represents the original gray levels and f is the brightness attenuation ratio.

In Step S40, the corrected original gray levels are transmitted to the display module and the computing module.

After the brightness attenuation ratio of the display panel transmitted by the computing module is received, the received value and an original value stored in the dynamic compensation table are added up as an updated brightness attenuation ratio to update the dynamic compensation table, and the corrected result is transmitted to the display module and the computing module.

In Step S50, the computing module computes an attenuation law and modifies the dynamic compensation table over time according to the corrected original gray levels.

In an example, an AMOLED display panel with a resolution of 1920*1080 is selected. The display panel includes three types of sub-pixels, that is, red, green, and blue sub-pixels. Gamma value γ of the AMOLED display panel is 2.2 by looking up a table.

In accordance with the brightness compensation method provided in the present disclosure, the aging experiment is first performed on the pre-selected AMOLED display panel.

Taking green sub-pixels for example, after the display panel displays a pure green color of gray level 64, 128, and 192 respectively for 200, 400, and 600 hours, measure and record the brightness of the display panel. The experimental result is shown in table 1 below. The brightness attenuation ratio is represented by (original brightness minus measured brightness)/(original brightness).

TABLE 1

A relation between brightness attenuation ratio, time, and gray level

| gray | time | | |
|---|---|---|---|
| level | 200 h | 400 h | 600 h |
| 64 | 1% | 2% | 4% |
| 128 | 5% | 10% | 20% |
| 192 | 13% | 26% | 52% |

According to the data in table 1 in combination with the formula $f=k\cdot\int(\text{gray}(t)\hat{}\gamma)dt$, it can be known that:

$$f=10^{-2}\cdot\int(\text{gray}(255)\hat{}2.2)dt, \quad 1\text{-}1$$

where f is the brightness attenuation ratio, gray represents the gray levels, and t is represented by hours.

Based on the formula 1-1, a dynamic compensation table with a size of 1920*1080*3 is established in the system. The data in this table and the sub-pixels form a one-to-one mapping.

In the usage, an original gray level is inputted to the formula 1-1 for correction to obtain an actual gray level, and then the brightness attenuation ratio of each of the sub-pixels is calculated and filled into the dynamic compensation table.

Figure 2:
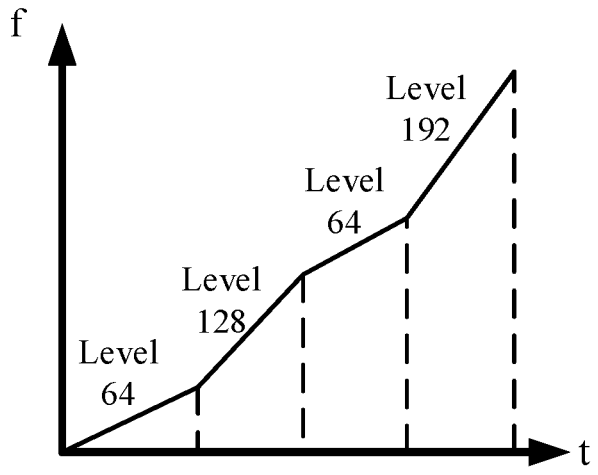
FIG. 2 is a graph of a gray level brightness attenuation ratio varying with time for a certain sub-pixel in accordance with a preferred embodiment of the present disclosure.

Taking a green sub-pixel in the $90^{th}$ row and the $90^{th}$ column for example, the gray level of the sub-pixel is shown in FIG. 2.

As can be seen from FIG. 2, gray level 64 is shown for the sub-pixel before the $100^{th}$ hour, gray level 128 is shown between the $101^{th}$ hour and the $200^{th}$ hour, gray level 64 is shown between the $201^{th}$ hour and the $300^{th}$ hour, and gray level 192 is shown between the $301^{th}$ hour and $400^{th}$ hour.

Based on the formula 1-1, the brightness attenuation ratio of the sub-pixel after the $400^{th}$ hour can be estimated as below:

$$f=10^{-2}\cdot\int(\text{gray}(255)\hat{}2.2)dt=16\%$$

In the dynamic compensation table, the brightness attenuation ratio of the green sub-pixel in the $90^{th}$ row and the $90^{th}$ column is 16%.

In normal usage, if an original gray level of the sub-pixel inputted to correcting module is 80, then it should be corrected as $80/(1-16\%)^{1/2.2}\approx 86$.

Figure 3:
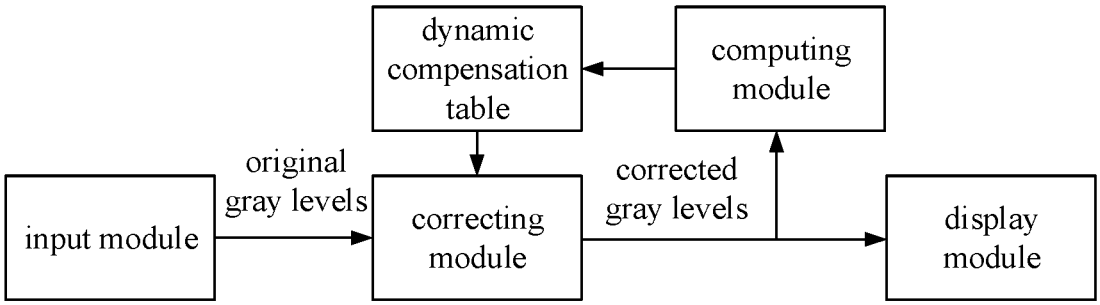
FIG. 3 is a schematic structural diagram showing a device for compensating brightness of an AMOLED display panel in accordance with the present disclosure.

FIG. 3 shows a device for compensating brightness of an AMOLED display panel provided in the present disclosure. The brightness compensating device includes a compensation circuit timing controller. The compensation circuit timing controller includes an input module, a correcting module, a computing module, a dynamic compensation table, and a display module.

First, an aging experiment is performed on the pre-selected AMOLED display panel, and measure and record a decline in brightness of sub-pixels on the display panel or a change of the brightness varied with time or a gray-level electric current. In the aging experiment, a display process causes a decrease in the brightness of each of the sub-pixels and a brightness attenuation ratio is obtained from the experiment.

Then, a compensation data and the dynamic compensation table are obtained according to the experimental data in combination with $f=k\cdot\int(\text{gray}(t)\hat{}\gamma)dt$. There is a one-to-one correspondence between the compensation data and at least one of a gray-level electric current, time, and a pixel brightness decline in the dynamic compensation table.

For example, assuming that the resolution of the display panel is 1920*1080, then the number of sub-pixels on the display panel is 1920*1080*3. Based on the aforesaid formula, a one-to-one mapping is formed between the sub-pixels and the data in the dynamic compensation table.

In the aforesaid formula, f is the brightness attenuation ratio, f corresponds to the compensation data, k is the pixel brightness decline per unit of time and per unit of electric current, gray(t) is the gray-level electric current at time t, $\gamma$ is a gamma value of the pre-selected AMOLED display panel, and t represents time.

Then, a video signal received by the input module is converted into original gray levels that are identifiable by a correcting module. The correcting module corrects the original gray levels according to the dynamic compensation table.

The correcting module corrects the inputted original gray levels according to the established dynamic compensation table. A correction formula used to correct the original gray levels is $x/(1-f)^{1/\gamma}$, where x represents the original gray levels and f is the brightness attenuation ratio.

Finally, the corrected original gray levels are transmitted to the display module and the computing module. The computing module computes an attenuation law and modifies the dynamic compensation table over time according to the corrected original gray levels.

After the brightness attenuation ratio of the display panel transmitted by the computing module is received, the received value and an original value stored in the dynamic compensation table are added up as an updated brightness attenuation ratio to update the dynamic compensation table, and the corrected result is transmitted to the display module and the computing module.

In an example, an AMOLED display panel with a resolution of 1920*1080 is selected. The display panel includes three types of sub-pixels, that is, red, green, and blue sub-pixels. Gamma value $\gamma$ of the AMOLED display panel is 2.2 by looking up a table.

In accordance with the brightness compensation device provided in the present disclosure, the aging experiment is first performed on the pre-selected AMOLED display panel using the brightness compensation device.

Taking green sub-pixels for example, after the display panel displays a pure green color of gray level 64, 128, and 192 respectively for 200, 400, and 600 hours, measure and record the brightness of the display panel. The experimental result is shown in table 2 below. The brightness attenuation ratio is represented by (original brightness minus measured brightness)/(original brightness).

TABLE 2

A relation between brightness attenuation ratio, time, and gray level

| gray level | time 200 h | 400 h | 600 h |
|---|---|---|---|
| 64 | 1% | 2% | 4% |
| 128 | 5% | 10% | 20% |
| 192 | 13% | 26% | 52% |

According to the data in table 2 in combination with the formula $f=k\cdot\int(\text{gray}(t)\hat{}\gamma)dt$, it can be known that:

$$f=10^{-2}\cdot\int(\text{gray}(255)\hat{}2.2)dt, \qquad 2\text{-}1$$

where f is the brightness attenuation ratio, gray represents the gray levels, and t is represented by hours.

Based on the formula 2-1, a dynamic compensation table with a size of 1920*1080*3 is established in the system. The data in this table and the sub-pixels form a one-to-one mapping.

In the usage, an original gray level is inputted to the formula 2-1 for correction to obtain an actual gray level, and then the brightness attenuation ratio of each of the sub-pixels is calculated and filled into the dynamic compensation table.

Figure 4:
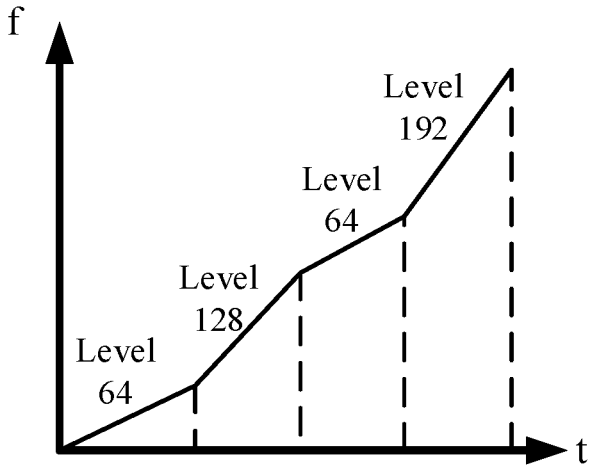
FIG. 4 is a graph of a gray level brightness attenuation ratio varying with time for a certain sub-pixel in accordance with a preferred embodiment of the present disclosure.

Taking a green sub-pixel in the $90^{th}$ row and the $90^{th}$ column for example, the gray level of the sub-pixel is shown in FIG. 4.

As can be seen from FIG. 4, gray level 64 is shown for the sub-pixel before the $100^{th}$ hour, gray level 128 is shown between the $101^{th}$ hour and the $200^{th}$ hour, gray level 64 is shown between the $201^{th}$ hour and the $300^{th}$ hour, and gray level 192 is shown between the $301^{th}$ hour and $400^{th}$ hour.

Based on the formula 2-1, the brightness attenuation ratio of the sub-pixel after the $400^{th}$ hour can be estimated as below:

$$f=10^{-2}\cdot\int(\text{gray}(255)\hat{}2.2)dt=16\%$$

In the dynamic compensation table, the brightness attenuation ratio of the green sub-pixel in the $90^{th}$ row and the $90^{th}$ column is 16%.

In normal usage, if an original gray level of the sub-pixel inputted to correcting module is 80, then it should be corrected as $80/(1-16\%)^{1/2.2}\approx 86$.

The present disclosure provides a method and device for compensating brightness of an AMOLED display panel. The method is simple, and the device is simple in structure and is easy to operate. By performing the aging experiment on the display panel in advance, an attenuation law that the brightness of sub-pixels varies with time and gray levels is obtained and an attenuation ratio is estimated based on the displayed gray level. Based on this, the inputted original gray levels are corrected and the brightness of sub-pixels are compensated such that the display panel displays images normally. The present disclosure can compensate the aging of thin film transistors and attenuation of luminance efficiency of OLED devices without it being necessary to dispose circuits or sensors in the display panels for luminance measurement.

What is claimed is:

1. A method for compensating brightness of an active-matrix organic light-emitting diode (AMOLED) display panel, comprising:

utilizing a compensation circuit cooperating with the AMOLED display panel to compensate the brightness of the AMOLED display panel by performing steps of:

converting a video signal into gray levels;

correcting the gray levels according to a dynamic compensation table;

enabling an image displayed with the corrected gray levels; and computing an attenuation law according to the corrected gray levels and modifying the dynamic compensation table over time based on the attenuation law, utilizing the AMOLED display panel to display the image with the corrected gray levels.

2. The method according to claim 1, before the converting step, further comprising:

utilizing a brightness compensation device cooperating with a pre-selected AMOLED display panel to compute a compensation data and generate the dynamic compensation table, wherein a one-to-one correspondence exists between the compensation data and at least one of a gray-level electric current, time, and a pixel brightness decline in the dynamic compensation table.

3. The method according to claim 2, wherein the step of computing the compensation data and generating the dynamic compensation table comprises:

utilizing the brightness compensation device to perform an aging experiment on the pre-selected AMOLED display panel to obtain experimental data; and obtaining the compensation data and the dynamic compensation table according to the experimental data in combination with $f=k\cdot\int(gray(t)\hat{}\gamma)dt$, where f is a brightness attenuation ratio, f corresponds to the compensation data, k is the pixel brightness decline per unit of time and per unit of electric current, gray(t) is the gray-level electric current at time t, γ is a gamma value of the pre-selected AMOLED display panel, and t represents time.

4. The method according to claim 3, wherein the correcting step comprises:

correcting the gray levels using the compensation data and a correction formula $x/(1-f)^{1/\gamma}$, where x represents the gray levels.

5. The method according to claim 1, wherein modifying the dynamic compensation table comprises:

after receiving a brightness attenuation ratio, adding up the received value and an original value stored in the dynamic compensation table as an updated brightness attenuation ratio, and updating the dynamic compensation table using the updated brightness attenuation ratio.

6. A system for compensating brightness of an active-matrix organic light-emitting diode (AMOLED) display panel, comprising:

a compensation circuit cooperating with the AMOLED display panel to compensate the brightness of the AMOLED display panel, the compensation circuit configured to:

convert a video signal into gray levels;

correct the gray levels according to a dynamic compensation table;

enable an image displayed with the corrected gray levels; and compute an attenuation law according to the corrected gray levels and modify the dynamic compensation table over time based on the attenuation law, the AMOLED display panel, configured to display the image with the corrected gray levels, wherein a one-to-one correspondence exists between a compensation data and at least one of a gray-level electric current, time, and a pixel brightness decline in the dynamic compensation table.

7. The system according to claim 6, wherein an aging experiment is performed on a pre-selected AMOLED display panel by utilizing a brightness compensation device to obtain experimental data; and wherein the compensation data and the dynamic compensation table are obtained according to the experimental data in combination with $f=k\cdot\int(gray(t)\hat{}\gamma)dt$, where f is a brightness attenuation ratio, f corresponds to the compensation data, k is the pixel brightness decline per unit of time and per unit of electric current, gray(t) is the gray-level electric current at time t, γ is a gamma value of the pre-selected AMOLED display panel, and t represents time.

8. The system according to claim 7, wherein the gray levels are corrected according to the brightness attenuation ratio stored in the dynamic compensation table; and wherein a correction formula used to correct the gray levels is $x/(1-f)^{1/\gamma}$, where x represents the gray levels.

9. The system according to claim 6, wherein after a brightness attenuation ratio is received, the received value and an original value stored in the dynamic compensation table are added up as an updated brightness attenuation ratio, and the dynamic compensation table is undated using the updated brightness attenuation ratio.

10. A system for compensating brightness of an active-matrix organic light-emitting diode (AMOLED) display panel, comprising:

a compensation circuit cooperating with the AMOLED display panel to compensate the brightness of the AMOLED display panel, the compensation circuit configured to:

convert a video signal into gray levels;

correct the gray levels according to a dynamic compensation table;

enable an image displayed with the corrected gray levels; and compute an attenuation law according to the corrected gray levels and modify the dynamic compensation table over time based on the attenuation law, the AMOLED display panel, configured to display the image with the corrected gray levels.

11. The system according to claim 10, wherein an aging experiment is performed on a pre-selected AMOLED display panel by utilizing a brightness compensation device to obtain experimental data; and wherein a compensation data and the dynamic compensation table are obtained according to the experimental data in combination with $f=k\cdot\int(gray(t)\hat{}\gamma)dt$, where f is a brightness attenuation ratio, f corresponds to the compensation data, k is the pixel brightness decline per unit of time and per unit of electric current, gray(t) is the gray-level electric current at time t, γ is a gamma value of the pre-selected AMOLED display panel, and t represents time.

12. The system according to claim 11, wherein the gray levels are corrected according to the brightness attenuation ratio stored in the dynamic compensation table; and wherein a correction formula used to correct the gray levels is $x/(1-f)^{1/\gamma}$, where x represents the gray levels.

13. The system according to claim 10, wherein after a brightness attenuation ratio is received, the received value and an original value stored in the dynamic compensation table are added up as an updated brightness attenuation ratio, and the dynamic compensation table is updated using the undated brightness attenuation ratio.

* * * * *